United States Patent [19]

Flavell et al.

[11] Patent Number: 4,501,132

[45] Date of Patent: Feb. 26, 1985

[54] PRESSER FOOT MECHANISM IN A KNITTING MACHINE

[75] Inventors: John Flavell, Coundon; Keith Jeffcoat, Nuneaton; Max W. Betts, Coventry, all of United Kingdom

[73] Assignee: Courtaulds PLC, London, England

[21] Appl. No.: 283,509

[22] Filed: Jul. 15, 1981

Related U.S. Application Data

[63] Continuation-in-part of Ser. No. 848,296, Nov. 3, 1977, abandoned.

[51] Int. Cl.[3] ..... D04B 7/04

[52] U.S. Cl. ..... 66/64

[58] Field of Search ..... 66/64, 147, 60

[56] References Cited

U.S. PATENT DOCUMENTS

| | | | |
|---|---|---|---|
| 3,952,553 | 4/1976 | Kohler | 66/64 |
| 3,973,416 | 8/1976 | Kohler | 66/64 |
| 4,027,504 | 6/1977 | Dietschy et al. | 66/64 |

*Primary Examiner*—Ronald Feldbaum

*Attorney, Agent, or Firm*—Davis, Hoxie, Faithfull & Hapgood

[57] ABSTRACT

A flat knitting machine including a presser foot assembly comprising a support mounted on the machine for movement along the needle array of the machine and at least one presser foot mounted on the support. The assembly includes a supporting arm carried on the support and itself carrying a slider on which a presser foot is mounted, the supporting arm providing a structure for effecting guided displacement of the slider up-and-down in relation to the needles. Resilient means, such as one or more springs, are arranged to urge the slider and presser foot down, away from the support, so that the presser foot can ride up on the supporting arm against the pressure of the resilient means and thus the whole of the presser foot extending from in advance of the rising needles to the rear of the fully raised needle position is resiliently mounted in the machine.

1 Claim, 5 Drawing Figures

PRESSER FOOT MECHANISM IN A KNITTING MACHINE

CROSS REFERENCES TO RELATED APPLICATIONS

The application of which this specification is a part is a continuation-in-part of application Ser. No. 848,296 filed Nov. 3, 1977, now abandoned.

BACKGROUND OF THE INVENTION

1. Field of the Invention

This invention relates to a flat knitting machine fitted with a presser foot mechanism. A flat V-bed machine having such a mechanism is described, for example, in U.S. Pat. No. 3,613,401.

2. Description of the Prior Art

Flat knitting machines are well known. The V-bed machine has two needle beds arranged with respect to one another in an "inverted V" configuration. Latch needles mounted in each needle bed form a needle array and the needles are operated to knit by a cam system carried in a cam box which moves along the needle array causing, according to the normal knitting action, successive needles to rise, take yarn and descend to form new stitches.

In conventional flat V-bed knitting machines the fabric which has been formed is pulled downward away from the needle beds by take-down rollers mounted beneath the needle beds. In a machine fitted with a presser foot mechanism a presser foot is moved along the needle array in synchronism with the cam box and pushes down on previously formed stitches from above. The presser foot thereby plays a part in controlling the stitch-forming action of the machine. A separate presser foot is provided for each cam system in the cam box.

SUMMARY OF THE INVENTION

The present inventors have found that it is advantageous to mount the presser foot for resilient up-and-down movement in relation to a support by which it is mounted for movement with the cam carriage. It is important that the presser foot should control the knitting action over substantially the whole of the needle movement, that is over the length of the cam system extending from in advance of the rising needles to the rear of the fully raised needles so that the presser foot will control stitches on the descending needles as well as on the rising needles. The significance of this point will be seen when one considers the descending needle which is about to cast off a previously formed stitch pulling a new loop of yarn through the previous stitch on the needle in the usual known knitting action. The latch of the descending needle has to move down in relation to this previous stitch so as to extend over it, the stitch being carried on the shank of the needle, and therefore this previous stitch must be tight against the shank since a loose stitch creates the risk that the descending latch will enter the stitch loop or penetrate the yarn forming the stitch and thus cause a fault in the knitting.

The control of the presser foot to press down the previously formed loops is thus required at all stages of the knitting operation including the part of the operation carried out by the descending needles. By mounting the whole of the presser foot, including a part of the foot extending to the rear of the fully raised needle position on a slidable resiliently urged mounting the present inventors have secured this overall control over all parts of the knitting operation.

Accordingly the invention provides in a flat knitting machine having a needle array containing needles operated by a cam system located in a cam box arranged to move, in use, along said needle array, and also having a support mounted for movement in synchronism with the cam box along the needle array and at least one presser foot mounted on said support, the improvement comprising (a) a supporting arm mounted on said support and projecting generally downward therefrom, (b) a slider, (c) structure on said supporting arm mounting said slider for sliding movement along said arm, (d) a presser foot carried on said slider, (e) said presser foot being thereby mounted for sliding movement on said supporting arm in a generally up-and-down direction, (f) resilient means arranged to urge said slider downwardly on said supporting arm, (g) said presser foot being located in a position in relation to said cam system such that the presser foot extends from a region in advance of the rising needles to the rear of the fully raised needles in said machine, and (h) said presser foot thus providing a resiliently mounted, slidably raisable element controlling stitches on the needles of the machine over the descending as well as rising movements of said needles.

BRIEF DESCRIPTION OF THE DRAWINGS

The invention will be further described, by way of example, with reference to the accompanying drawings in which.

DESCRIPTION OF THE PREFERRED EMBODIMENT

Figure 1:
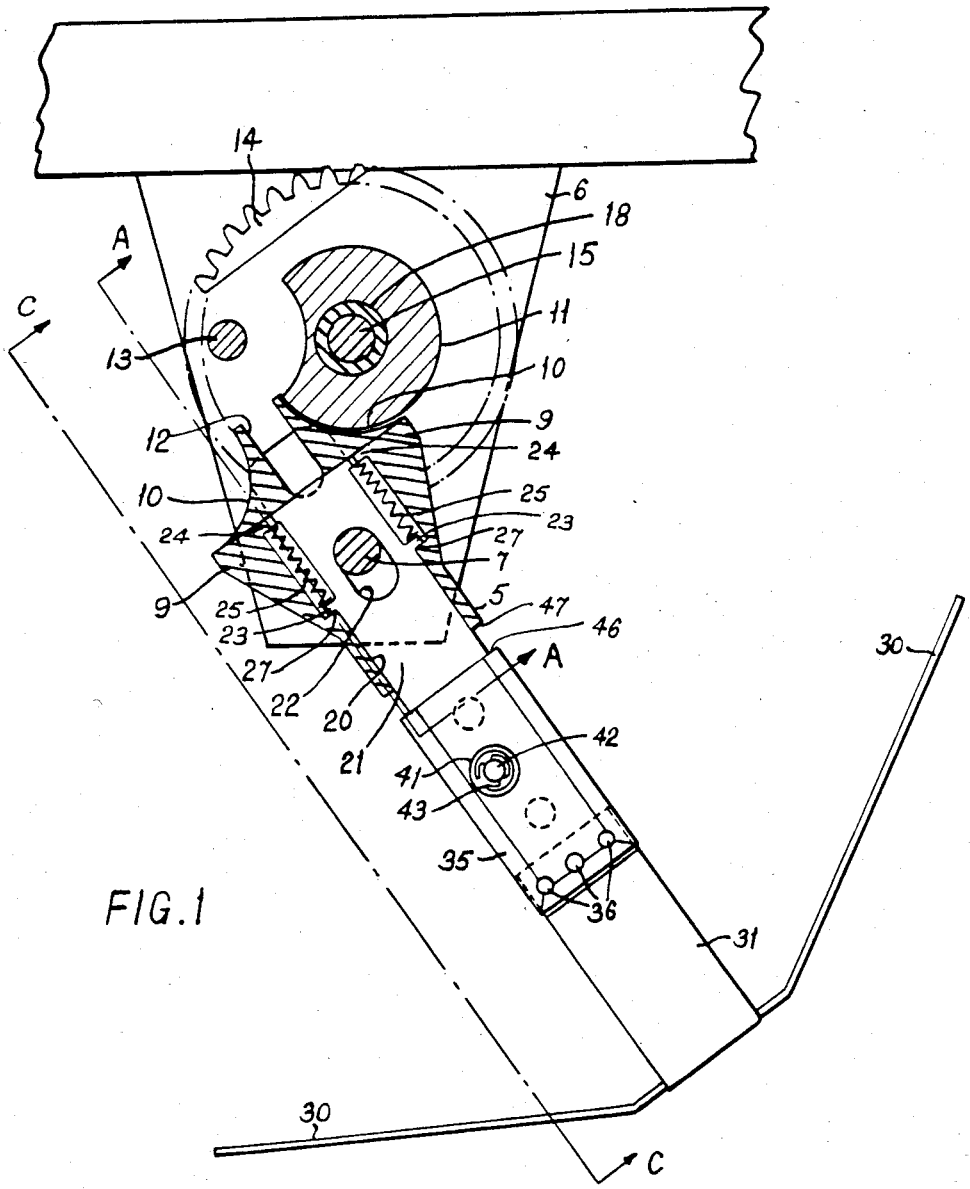
FIG. 1 is an elevation, sectional on the line B—B of FIG. 3, of a presser foot assembly according to the invention and also shows some parts of a support for mounting the presser foot assembly on a cam carriage.
Figure 3:
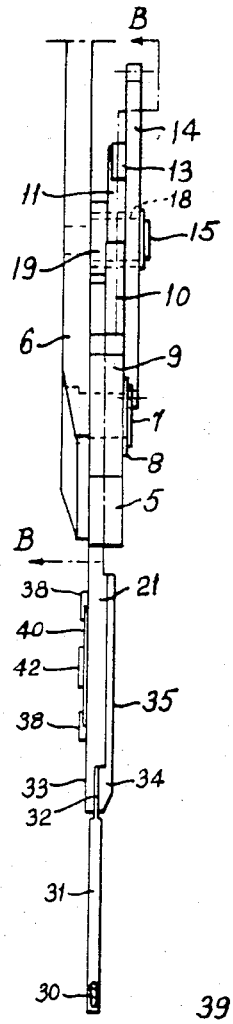
FIG. 3 is a side view of the presser foot assembly of FIG. 1, as viewed from the plane C—C, and sectional in that plane.
Figure 2:
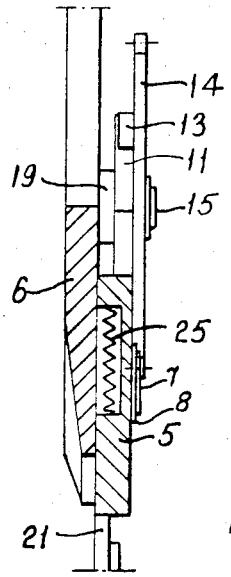
FIG. 2 is a section on the line A—A of FIG. 1.
Figure 4:
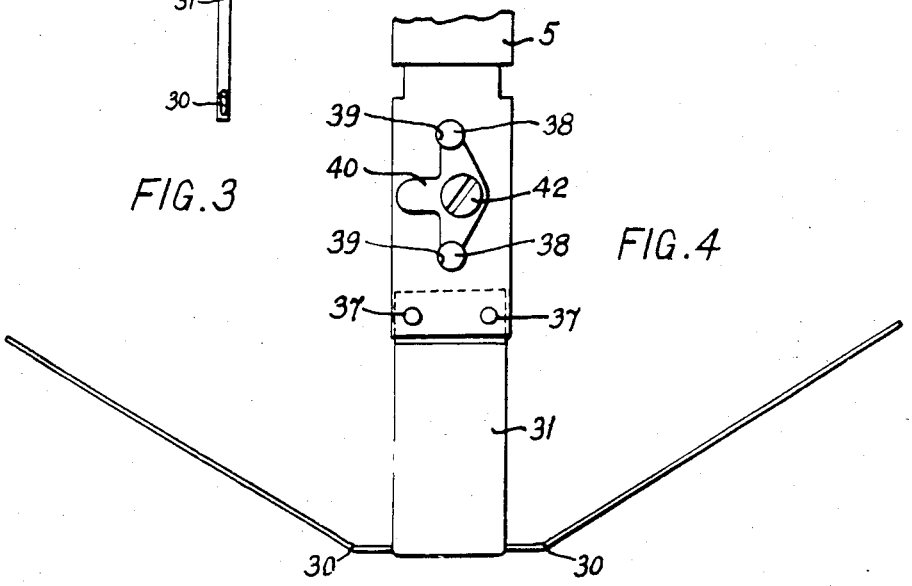
FIG. 4 is a rear view of the lower part of the presser foot assembly of FIG. 1.

The presser foot assembly shown in the drawings comprises a supporting arm 5 pivotally mounted on a support including a supporting plate 6 mounted on the cam boxes of a flat V-bed knitting machine so that the support and the presser foot assembly move along the needle array of the machine in synchronism with the cam box. The arm 5 is mounted on the plate 6 by means of a stud 7 on which it is secured by a circlip 8. The arm 5 has wings 9 formed with arcuate surfaces 10 for co-operation with a cut-away boss 11 and is slotted at 12 for co-operation with a pin 13 on a toothed wheel 14 of a geneva gear mechanism. The wheel 14 is rotatably mounted on a stud 15 secured on the plate 6 and, when the presser foot assembly is mounted in a knitting machine, is rotated at the end of each traverse of the cam carriage by a rack (not shown). Such rotation of the wheel 14 causes pivoting movement of the arm 5 to an alternative position appropriate for movement of the presser foot assembly, together with the cam carriage, in the opposite direction along the needle beds of the knitting machine.

A spacer 18 surrounds the part of the stud 15 which projects out of the plate 6 and a washer 19 spaces the wheel 14 from the plate 6.

Slidable in a channel 20 formed in the arm 5 is a slider 21 which has a slot 22 to allow passage through it of the stud 7. The slider 21 is retained in the channel 20 by the plate 6, the channel 20 and plate 6 thus forming together structure on the supporting arm 5 which mounts the slider 21 for sliding movement on the arm 5. At its upper end, the slider 21 is formed with shoulders 23 and at the upper end of the channel 20 are projecting abutments 24. Between each shoulder 23 and the corresponding abutment 24 is located a helical spring 25. The springs 25 urge the slider 21 downwardly in FIG. 1 until the shoulders 23 each abut against a corresponding ledge 27 in a side wall of the channel 20.

On the lower end of the slider 21 is mounted a pair of presser feet 30. The presser feet are rigidly carried on a blade 31 made of a carbon fibre composite and the blade is secured on the slider 21 as follows:

A thinner end portion 32 of the blade 31 is pierced by three holes and lies between a lip 33 on the slider 21 and a thickened end portion 34 on a cover plate 35. Three studs 36 set in the end portion 34 extend through the holes in the portion 32 of the blade 31 and thus secure the blade. The two outer studs 36 extend into holes 37 in the lip 33 but the centre stud 36 is shorter and merely abuts against the surface of the lip 33.

The cover plate 35 has two pins 38 which extend through holes 39 in the slider 21 and locate the cover plate on the slider. The pins 38 project from the slider 21 and are slotted to receive the arms of a turnbuckle 40 which locks the cover plate 35 on the slider. A hole 41 in the cover plate 35 accommodates the head of a stud 42 carrying the turnbuckle 40. A circlip 43 locks the stud 42 and turnbuckle on the slider 21.

When the cover plate 35 is located on the slider 21, the end portion 34 is spaced from the lip 33 by a distance greater than the thickness of the end portion 32 of the blade 31 so that the blade has some movement between the end portion 34 and the lip 33 to allow the presser feet some lateral movement between the needle beds of the knitting machine.

In FIG. 1, the left-hand, lower presser foot 30 is in its operative position to push down knitted fabric. The height of the support (not shown) of which the plate 6 is a part is adjusted so that when the presser foot meets knitted fabric held on the needles it will ride up slightly from the position shown in FIG. 1, this movement being possible because of upward sliding movement of the slider 21 in the channel 20 against the resilience of the springs 25. The upward limit of movement is governed by abutment of a shoulder 46 on the slider 21 against the lower end 47 of the arm 5.

Within the limits of its generally up-and-down movement in relation to the needle beds and needles, the presser foot thus exerts resilient pressure on the knitting and if the knitting machine is a double system machine, in which case a pair of presser feet mounted as described above, on a common support, are provided for each system of knitting cams, then each of the two presser feet operative during any traverse can adjust to different heights in relation to the needle beds. This is important because the trailing operative presser foot in any traverse acts on knitted fabric containing one additional course compared with the leading presser foot since the leading presser foot co-operates in the formation of that additional course.

In the presser foot assembly described above with reference to the drawings, the length of the slot 22 may be varied according to the gauge of the knitting machine with which it is used, so that in fine gauge machines the degree of movement permitted to the presser foot or presser feet is less than in coarser gauge machines.

Figure 5:
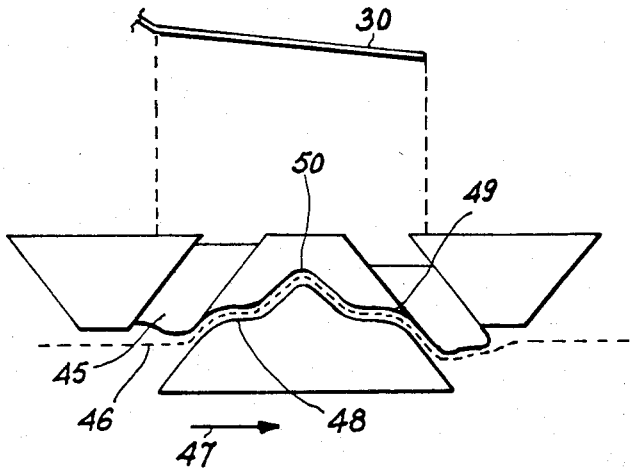
FIG. 5 is a diagram illustrating the location of a presser foot in the presser foot assembly of FIGS. 1 to 4 in relation to a cam system with which it is associated.

FIG. 5 illustrates the location of a presser foot 30 in relation to the cam system 45 with which it is associated in the knitting machine. The cam system 45 defines a track 46 shown in broken lines which the needle butts follow in the direction of the arrow 47 as they pass through the cam system which acts on the butts to raise the needles to knitting height to take new yarn and lower them to cast off their previously formed loops. The rising needles are thus found in the section 48 of the cam system and the descending needles in section 49. The fully raised needles are to be found in the section 50 of of the cam system and the cam system moves to the left in FIG. 5 during its co-operation with the presser foot 30 shown in the Figure so that the section 49 of the cam box is to the rear of the fully raised needles in section 50.

The presser foot 30 extends from in advance of the rising needles in section 48 of the cam system 45 to the rear of the fully raised needles in section 50 and the whole of the presser foot is slidably raisable with the slider 21 on the arm 5 and is resiliently urged downwardly on that arm.

What is claimed is:

1. In a flat knitting machine having two opposed needle beds each having a needle array containing needles operated by a cam system located in a cam box arranged to move, in use, along said needle arrays, and also having a support mounted for movement in synchronism with the cam box along the needle arrays, a presser foot assembly for pressing down on fabric as it is knitted, comprising:

(a) a supporting arm mounted on said support and projecting generally downward therefrom;

(b) a slider;

(c) structure on said supporting arm mounting said slider for sliding movement along said arm substantially midway between said needle beds;

(d) a unitary presser foot carried entirely on said slider;

(e) said presser foot being thereby mounted for sliding movement on said supporting arm in a generally up-and-down direction;

(f) resilient means arranged to urge said slider downwardly on said supporting arm;

(g) said presser foot being located in a position in relation to said cam system such that the presser foot extends from a region in advance of the rising needles to the rear of the fully raised needles in said machine; and (h) said presser foot thus providing a resiliently mounted slidably raisable element controlling stitches on the needles of the machine over descending as well as rising movement of said needles.

* * * * *